US009815320B2

(12) United States Patent
Khangar et al.

(10) Patent No.: US 9,815,320 B2
(45) Date of Patent: Nov. 14, 2017

(54) CHALK LINE DEVICE

(71) Applicant: Milwaukee Electric Tool Corporation, Brookfield, WI (US)

(72) Inventors: Abhijeet A. Khangar, Waukesha, WI (US); Andrew G. Gongola, Brookfield, WI (US); Christopher S. Hoppe, Milwaukee, WI (US); Michael S. Steele, Waukesha, WI (US); Collin J. Nelson, Milwaukee, WI (US); Daniel H. Schneider, Franklin, WI (US); Roger D. Neitzell, Palmyra, WI (US); Steven W. Hyma, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 159 days.

(21) Appl. No.: 14/870,681

(22) Filed: Sep. 30, 2015

(65) Prior Publication Data

US 2016/0096396 A1 Apr. 7, 2016

Related U.S. Application Data

(60) Provisional application No. 62/058,929, filed on Oct. 2, 2014, provisional application No. 62/079,236, filed on Nov. 13, 2014, provisional application No. 62/142,309, filed on Apr. 2, 2015, provisional application No. 62/142,193, filed on Apr. 2, 2015.

(51) Int. Cl.
*B44D 3/38* (2006.01)

(52) U.S. Cl.
CPC ..... *B44D 3/38* (2013.01)

(58) Field of Classification Search
CPC ..... B25H 7/04; B44D 3/38
USPC .... 33/413, 414; 242/394, 394.1, 395, 395.1, 242/407
See application file for complete search history.

(56) References Cited

U.S. PATENT DOCUMENTS 648,044 A * 4/1900 Miller ..... B44D 3/38 242/395.1
665,119 A * 1/1901 Latter ..... B44D 3/38 33/414

(Continued)

FOREIGN PATENT DOCUMENTS

DE 20015210 4/2001
EP 0194993 9/1986

(Continued)

*Primary Examiner* — Richard A Smith
(74) *Attorney, Agent, or Firm* — Michael Best & Friedrich LLP

(57) ABSTRACT

A chalk line device includes a housing, a spool, a chalk line, a hook, and a cap. The housing defines an outer surface and an internal chamber, and the housing includes an opening. The spool is supported in the internal chamber for rotation relative to the housing. The chalk line extends through the opening of the housing and the chalk line includes a first end and a second end. At least a portion of the chalk line is wrapped around the spool. The hook is secured to the first end of the chalk line and includes a tip adapted to engage a work piece. The cap is removably coupled to the housing to cover the opening. The cap includes a nozzle through which the chalk line extends and a projection for engaging and releasably securing the hook against the cap.

21 Claims, 11 Drawing Sheets

(56) References Cited

U.S. PATENT DOCUMENTS 842,858 A * 2/1907 Cavileer ..... B44D 3/38 33/414
1,555,167 A 9/1925 Switzer
3,438,595 A 4/1969 Brown et al.
3,691,639 A 9/1972 Roeseler et al.
3,979,833 A * 9/1976 Grundman ..... G01B 3/1084 242/388
4,189,844 A 2/1980 Riggins, Sr.
4,197,656 A 4/1980 Lane et al.
4,272,036 A 6/1981 Watermann
4,513,772 A * 4/1985 Fisher ..... B65H 75/4407 137/355.22
4,580,347 A 4/1986 McKnight
4,592,148 A * 6/1986 Longenette ..... B44D 3/38 242/375.1
4,606,134 A 8/1986 Flick
4,660,291 A 4/1987 Dehn
4,679,325 A 7/1987 Sweatman
4,731,933 A 3/1988 Cope
4,765,557 A 8/1988 Kahmann
4,806,039 A 2/1989 Kawamura
4,813,145 A 3/1989 Josey, Jr. et al.
4,819,337 A 4/1989 Noyes
4,926,562 A 5/1990 Hwu
4,965,941 A 10/1990 Agostinacci
5,042,159 A 8/1991 Millen
5,063,681 A 11/1991 Bradley
5,163,230 A 11/1992 Gast
5,212,875 A 5/1993 Corso
D339,044 S 9/1993 Kennedy
D345,513 S 3/1994 Syrett
5,444,919 A 8/1995 Alves
5,465,494 A 11/1995 Johnston
5,493,787 A 2/1996 Owens
5,509,616 A 4/1996 Millen, Jr. et al.
5,588,610 A 12/1996 McGee
5,644,852 A 7/1997 Fuller et al.
5,683,055 A 11/1997 Dufour
5,718,056 A * 2/1998 Miyasaka et al. ... G01B 3/1005 242/395.1
5,727,324 A 3/1998 Moore
5,822,874 A 10/1998 Nemes
5,920,997 A 7/1999 Girtman
5,937,532 A 8/1999 Eirich et al.
6,079,112 A 6/2000 Love
6,082,014 A 7/2000 Beyers
6,098,299 A 8/2000 Collins et al.
6,108,926 A 8/2000 Fraser et al.
D435,469 S 12/2000 Jones
6,203,602 B1 3/2001 Rangell
D445,701 S 7/2001 Hutchings
6,289,597 B1 9/2001 Beyers
6,345,448 B1 2/2002 Chontos
D454,804 S 3/2002 Zuniga
6,393,709 B1 5/2002 Jones
6,405,444 B1 6/2002 Osborne
6,415,519 B1 7/2002 Bennett
6,434,843 B1 8/2002 Shor
6,470,581 B1 10/2002 Kolodzieski
6,484,412 B1 11/2002 Donaldson et al.
6,487,783 B1 12/2002 Thomas, Jr.
D473,805 S 4/2003 Dekort
D477,785 S 7/2003 Szumer
D477,786 S 7/2003 Szumer
6,637,125 B2 10/2003 Scarborough
6,678,961 B1 1/2004 Panahi
6,698,104 B2 3/2004 Scarborough
6,701,635 B2 3/2004 Scarborough
6,701,636 B2 3/2004 Scarborough
6,705,018 B2 3/2004 Guhse
D490,329 S 5/2004 Glessman
D493,377 S 7/2004 Brugger
6,789,329 B1 9/2004 Hester
D499,030 S 11/2004 Searls
6,826,845 B2 12/2004 Pritchard
6,895,679 B2 5/2005 Dekort
6,910,280 B2 6/2005 Scarborough
6,915,587 B1 7/2005 Scillia et al.
6,931,742 B1 8/2005 VanWinkle
6,931,743 B1 8/2005 Scarborough
6,941,672 B2 9/2005 Scarborough
6,944,962 B2 9/2005 Tessel et al.
6,957,495 B1 10/2005 Schmillen
6,964,109 B1 11/2005 Bond
7,028,411 B1 4/2006 Kasche
7,086,174 B2 8/2006 Scarborough
D532,327 S 11/2006 Ping
D532,328 S 11/2006 Ping
7,197,831 B2 4/2007 Nepil
7,197,832 B2 4/2007 Bond
7,200,949 B2 4/2007 Leslie et al.
7,231,722 B2 6/2007 Hickey et al.
7,260,899 B2 8/2007 Jones
7,299,558 B2 11/2007 Wang
7,311,283 B2 * 12/2007 Whitney ..... B44D 3/38 242/394
7,331,116 B1 2/2008 Johnston et al.
7,334,344 B2 2/2008 Scarborough
7,367,130 B2 5/2008 Vary
7,374,123 B2 5/2008 Han
D570,233 S 6/2008 Levinson et al.
D573,046 S 7/2008 Levinson
D576,894 S 9/2008 Levinson
D579,355 S 10/2008 Nepil et al.
7,469,482 B2 12/2008 Hickey et al.
7,478,484 B2 1/2009 Nepil et al.
7,506,454 B1 3/2009 Balliet
7,536,799 B2 5/2009 Nepil et al.
7,536,800 B2 5/2009 Nepil et al.
D594,355 S 6/2009 Levinson et al.
7,559,501 B2 * 7/2009 Jian ..... B65H 75/4407 137/355.23
7,624,509 B2 12/2009 Hanson et al.
7,676,941 B2 3/2010 Cruz et al.
7,681,826 B2 3/2010 Whitney
7,707,734 B2 5/2010 Alexander
7,735,231 B2 6/2010 Schardt
7,770,300 B2 8/2010 Johnson
RE41,620 E 9/2010 Scillia et al.
D632,983 S 2/2011 Moore
7,908,754 B2 3/2011 Fritsch
7,913,408 B2 3/2011 Grisham
7,913,409 B2 3/2011 Wilson
8,033,029 B2 10/2011 Johnston et al.
8,533,966 B2 9/2013 Mikhaylenko
8,713,810 B2 5/2014 Spaulding
2002/0026723 A1 3/2002 Savalla
2003/0160122 A1 8/2003 Girtman et al.
2004/0211074 A1 10/2004 Tessel et al.
2004/0221469 A1 11/2004 Risher
2005/0087645 A1 * 4/2005 Tracey et al. ..... B65H 75/4492 242/394.1
2007/0068021 A1 3/2007 Fisher
2008/0052935 A1 * 3/2008 Hanson et al. ..... B44D 3/38 33/414
2008/0156923 A1 * 7/2008 Burch et al. ..... B65H 75/40 242/407
2008/0236442 A1 10/2008 Spaulding et al.
2008/0295347 A1 12/2008 Braham
2012/0216414 A1 8/2012 Jones et al.
2014/0109417 A1 4/2014 Kocenko
2016/0347117 A1 * 12/2016 Parker et al. ..... B44D 3/38

FOREIGN PATENT DOCUMENTS

EP 2420390 A1 2/2012
EP 2420389 2/2013
EP 2420388 7/2013
GB 553446 A * 5/1943 ..... B44D 3/38
JP 3298056 7/2002

(56) References Cited

FOREIGN PATENT DOCUMENTS

| | | | | |
|---|---|---|---|---|
| JP | 4205887 | | 1/2009 | |
| TW | 076729 | Y | 4/1986 | |
| TW | 098478 | Y | 4/1988 | |
| TW | 122233 | Y | 11/1989 | |
| TW | 132645 | Y | 4/1990 | |
| TW | 137947 | Y | 7/1990 | |
| TW | 143253 | Y | 10/1990 | |
| TW | 163792 | Y | 7/1991 | |
| TW | 168308 | Y | 9/1991 | |
| TW | 174463 | Y | 12/1991 | |
| TW | 175695 | Y | 12/1991 | |
| TW | 179845 | Y | 3/1992 | |
| TW | 190032 | Y | 9/1992 | |
| TW | 208214 | Y | 6/1993 | |
| TW | 227697 | Y | 8/1994 | |
| TW | 232208 | Y | 10/1994 | |
| TW | 236216 | Y | 12/1994 | |
| TW | 277386 | Y | 6/1996 | |
| TW | 344340 | Y | 11/1998 | |
| TW | 351250 | Y | 1/1999 | |
| TW | 352625 | Y | 2/1999 | |
| TW | M251705 | U | 12/2004 | |
| TW | M251706 | | 12/2004 | |
| TW | M283168 | U | 12/2005 | |
| TW | 20062431 | A | 7/2006 | |
| TW | M314105 | U | 6/2007 | |
| TW | M325904 | U | 1/2008 | |
| TW | M338734 | U | 8/2008 | |
| TW | M349831 | U | 2/2009 | |
| TW | M355804 | U | 5/2009 | |
| TW | M428822 | U | 5/2012 | |
| TW | 201235173 | A | 9/2012 | |
| WO | WO 0134410 | A1 * | 5/2001 | ..... B44D 3/38 |
| WO | WO 2006035423 | | 4/2006 | |
| WO | WO 2007113811 | | 10/2007 | |
| WO | WO 2008154270 | | 12/2008 | |
| WO | WO 2010104302 | | 1/2011 | |

* cited by examiner

CHALK LINE DEVICE

CROSS-REFERENCE TO RELATED APPLICATIONS

This application claims the benefit of the prior-filed, U.S. Provisional Patent Application Ser. No. 62/058,929, filed Oct. 2, 2014, U.S. Provisional Patent Application Ser. No. 62/079,236, filed Nov. 13, 2014, U.S. Provisional Patent Application Ser. No. 62/142,309, filed Apr. 2, 2015, and U.S. Provisional Patent Application Ser. No. 62/142,193, filed Apr. 2, 2015. The entire contents of these documents are incorporated herein by reference.

BACKGROUND

The present application relates to hand tools and in particular to a chalk reel or chalk line device.

Conventional chalk reels include a housing, a spool positioned within the housing, and a chalk line wrapped onto the spool. A chalk material is also positioned in the housing to coat the chalk line. A hook is secured to an end of the chalk line, and another end of the chalk line is secured to the spool. The spool is rotatable about an axis and the spool may be manually rotated by operation of a crank or lever. A user may extract the line from the housing, position the line against a work surface, and snap the line in order to create a clear chalk line on the work surface.

SUMMARY

In one embodiment, a chalk line device includes a housing, a spool, a chalk line, a hook, and a cap. The housing defines an outer surface and an internal chamber, and the housing includes an opening. The spool is supported in the internal chamber for rotation relative to the housing. The chalk line extends through the opening of the housing and the chalk line includes a first end and a second end. At least a portion of the chalk line is wrapped around the spool. The hook is secured to the first end of the chalk line and includes a tip adapted to engage a work piece. The cap is removably coupled to the housing to cover the opening. The cap includes a nozzle through which the chalk line extends and a projection for engaging and releasably securing the hook against the cap.

In another embodiment, a chalk line device includes a housing, a spool, a chalk line, a drive mechanism for rotating the spool, and a clutch mechanism. The housing defines an outer surface and an internal chamber, and the housing includes an opening. The spool is supported in the internal chamber for rotation relative to the housing about a spool axis. The chalk line extends through the opening of the housing, and at least a portion of the chalk line is wrapped around the spool. The drive mechanism includes a lever and a gear member. The gear member is directly coupled to the spool at a spool interface. The lever is positioned proximate the outer surface and supported for rotation relative to the housing. Rotation of the lever transmits a torque to the gear member, which in turn transmits a torque to the spool to rotate the spool. The clutch mechanism selectively uncouples the gear from the spool at the spool interface when a torque transmitted by the gear member to the spool exceeds a predetermined threshold.

In yet another embodiment, the chalk line device includes a housing, a lever supported for rotation relative to the housing, a chalk line, and a spool. The housing defines an outer surface and an internal chamber, and the housing includes an opening. The chalk line extends through the opening of the housing such that an end of the chalk line is positioned outside of the internal chamber and a portion of the chalk line is supported in the internal chamber. The spool is supported in the internal chamber for rotation relative to the housing about a spool axis, and the spool is driven by rotation of the lever. The spool includes a pair of side walls and a hub extending between the pair of side walls. The hub extends around the spool axis, and the portion of the chalk line is wrapped around the hub. At least one of the side walls includes an inner portion, a peripheral portion, and a plurality of support members extending between the inner portion and the peripheral portion. Each support member is oriented parallel to and offset from a radial line that extends outwardly from the spool axis toward the peripheral portion. The plurality of support members define a plurality of openings positioned between each of the support members and extending through the side wall to permit chalk to pass through the side wall.

Other independent aspects will become apparent by consideration of the detailed description and accompanying drawings.

Before any embodiments are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

DETAILED DESCRIPTION

Figure 1:
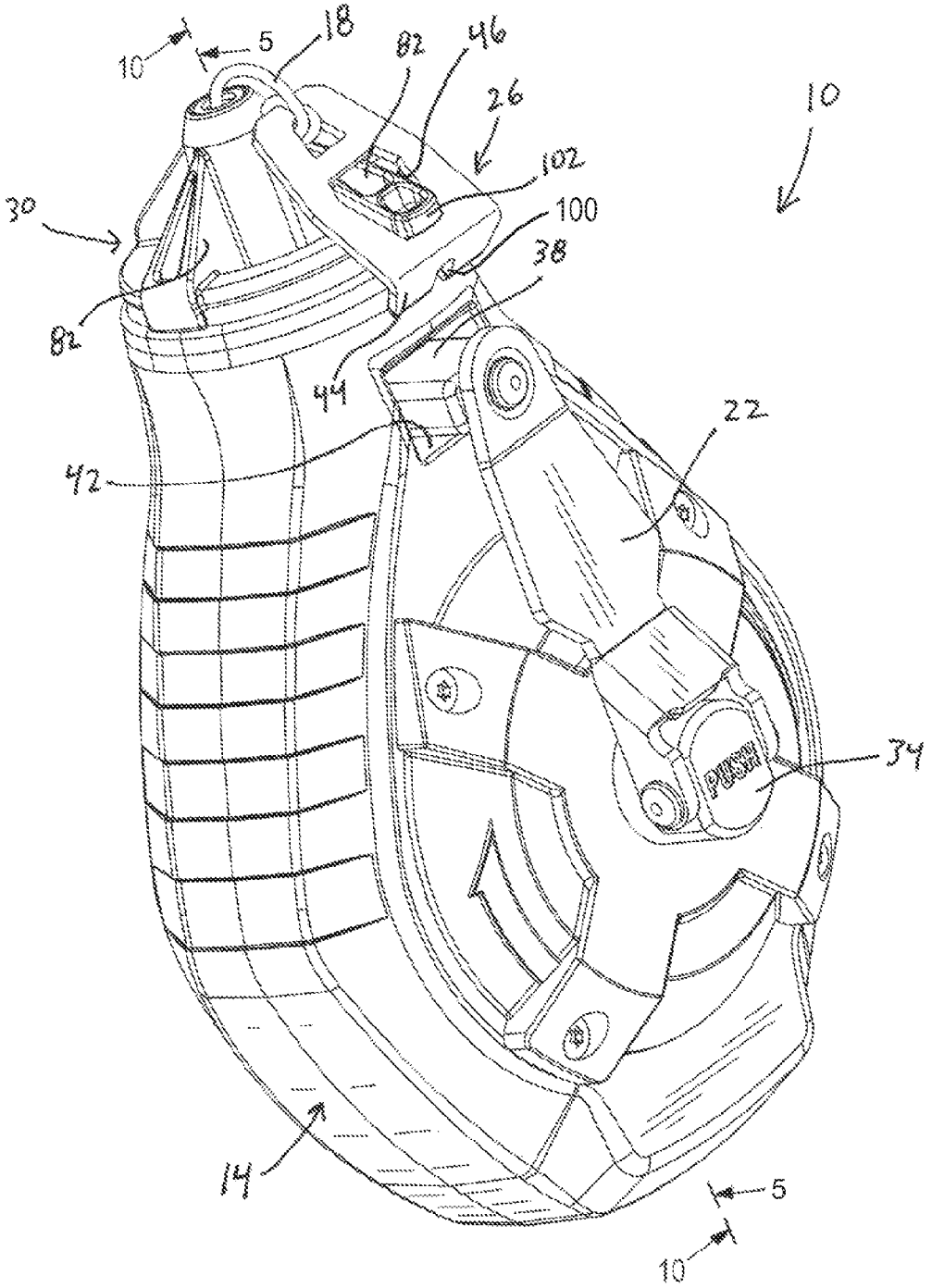
FIG. 1 is a perspective view of a chalk line device.
Figure 13:
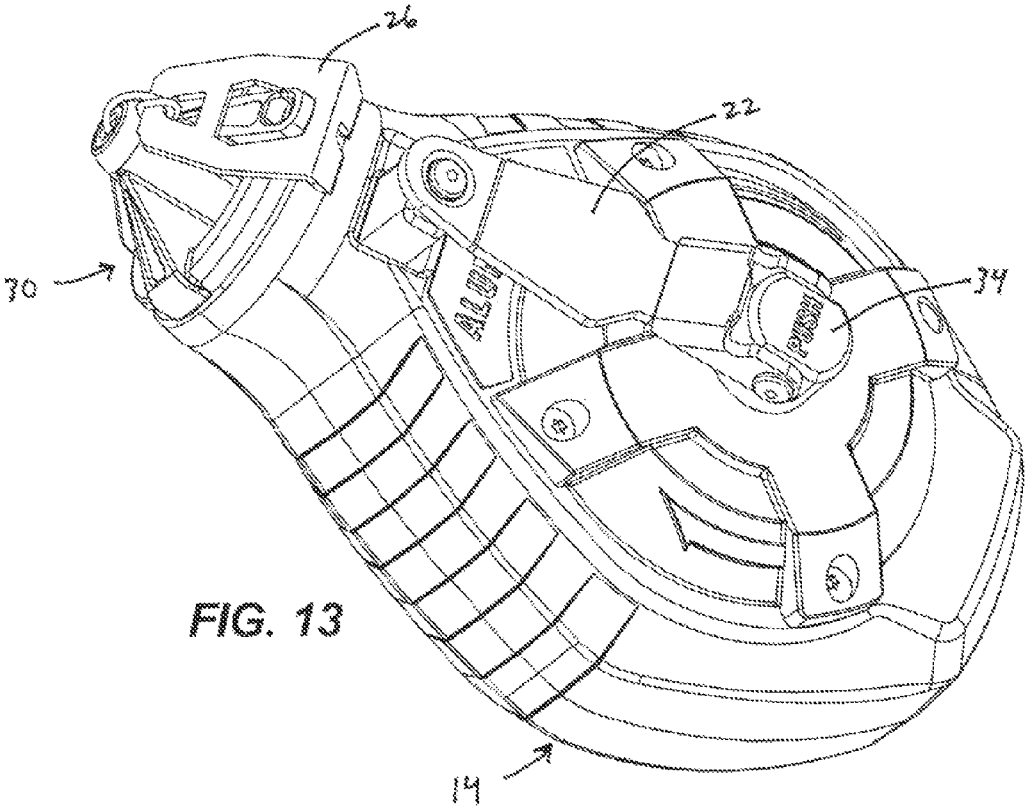
FIG. 13 is a perspective view of a chalk line device according to another embodiment.

FIG. 1 illustrates a chalk reel or chalk line device 10 including a housing 14, a chalk line 18, a lever 22, a hook 26 secured to one end of the chalk line 18, and a cap 30 secured to the housing 14. In one embodiment, the housing 14 is formed from die cast aluminum; in another embodiment (FIG. 13), the housing 14 is formed from a plastic base overmolded with rubber or plastic.

The chalk line 18 may be constructed of Dacron®, or it may be a polyester blend (e.g., polyester nylon). In some embodiments, the chalk line 18 is formed by braiding sixteen strands and has between approximately 26 and approximately 34 picks per inch. As used herein, a "pick" refers to a linear or axial distance between two adjacent strand crossings. In some embodiments, the chalk line 18 has a diameter between approximately 1.05 mm and approximately 1.15 mm, and has a minimum tensile strength of 40 lbf. In some embodiments, the chalk line 18 has 30 picks per inch and a diameter of approximately 1.1 mm, providing a tensile strength of 49.6 lbf.

The lever 22 is supported for rotation on one side of the housing 14. One end of the lever 22 is coupled to an end of a post 34 that is coupled to the housing 14. The lever 22 is pivotable about the end of the post 34 between an open position and a stowed position (illustrated in FIG. 1). Another end of the lever 22 includes a handle 38 to be gripped by a user when rotating the lever 22. In the illustrated embodiment, the housing 14 includes a recess 42, and the handle 38 is positioned in the recess 42 when the lever 22 is in the stowed position.

Figure 2:
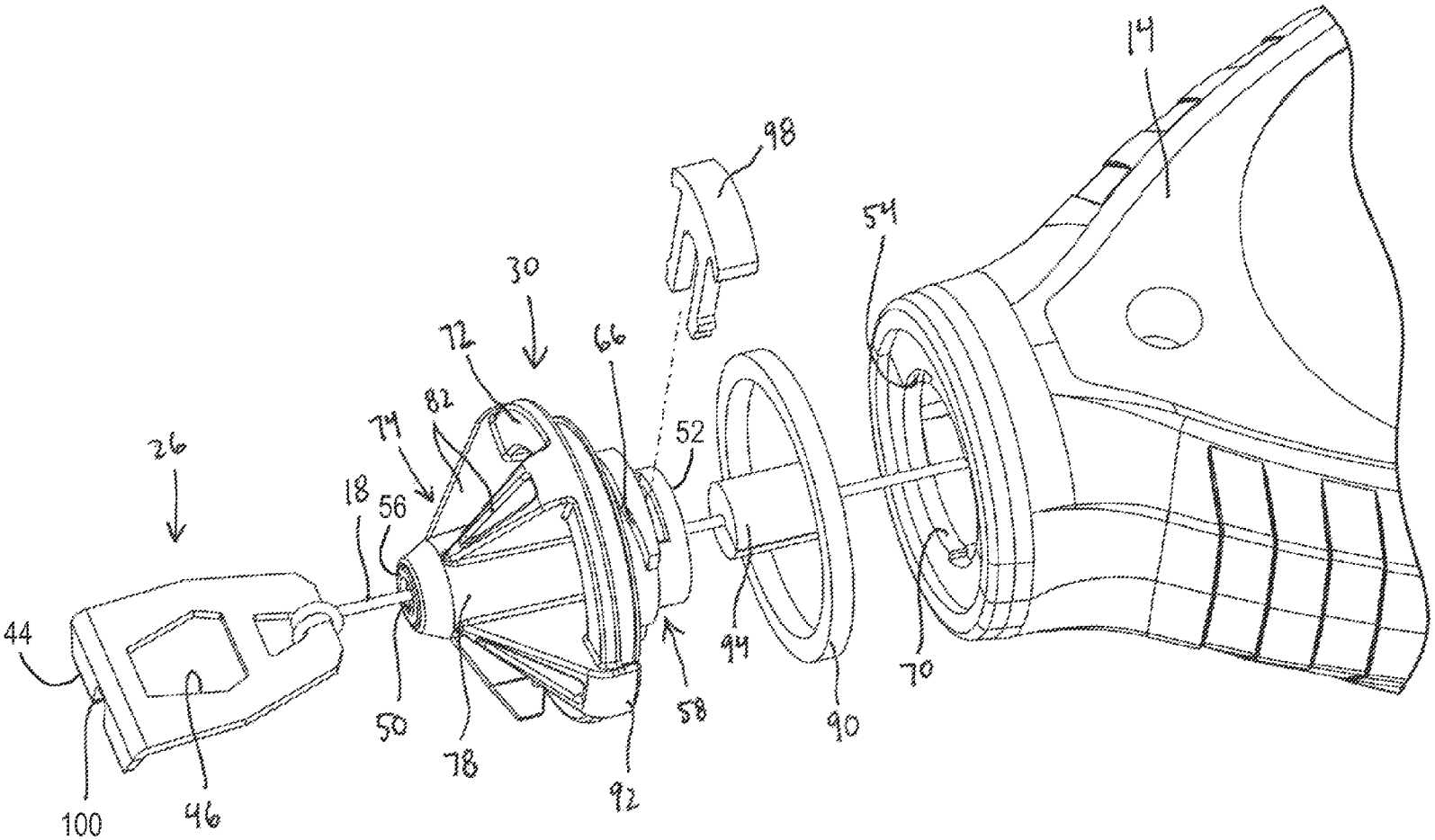
FIG. 2 is an exploded view of a portion of the chalk line device of FIG. 1.

Referring to FIG. 2, the hook 26 includes a first end secured to an end of the chalk line 18 and a second end including a tip or gripping edge 44. The gripping edge 44 engages a work piece (not shown) while the chalk line 18 is snapped by a user to impart a chalk mark. The hook 26 also includes a slot 46 positioned between the end of the chalk line 18 and the gripping edge 44.

The cap 30 includes a nozzle 50 extending through the cap 30, and the chalk line 18 passes through the nozzle 50. One end of the chalk line 18 is secured to the hook 26, and a portion of the chalk line 18 is positioned in the housing 14 as described in further detail below. The chalk line 18 can be drawn out of the housing 14 by applying a force on the hook 26, and the chalk line 18 can be reeled in or retracted into the housing 14 by rotating the lever 22 (FIG. 1).

Figure 3:
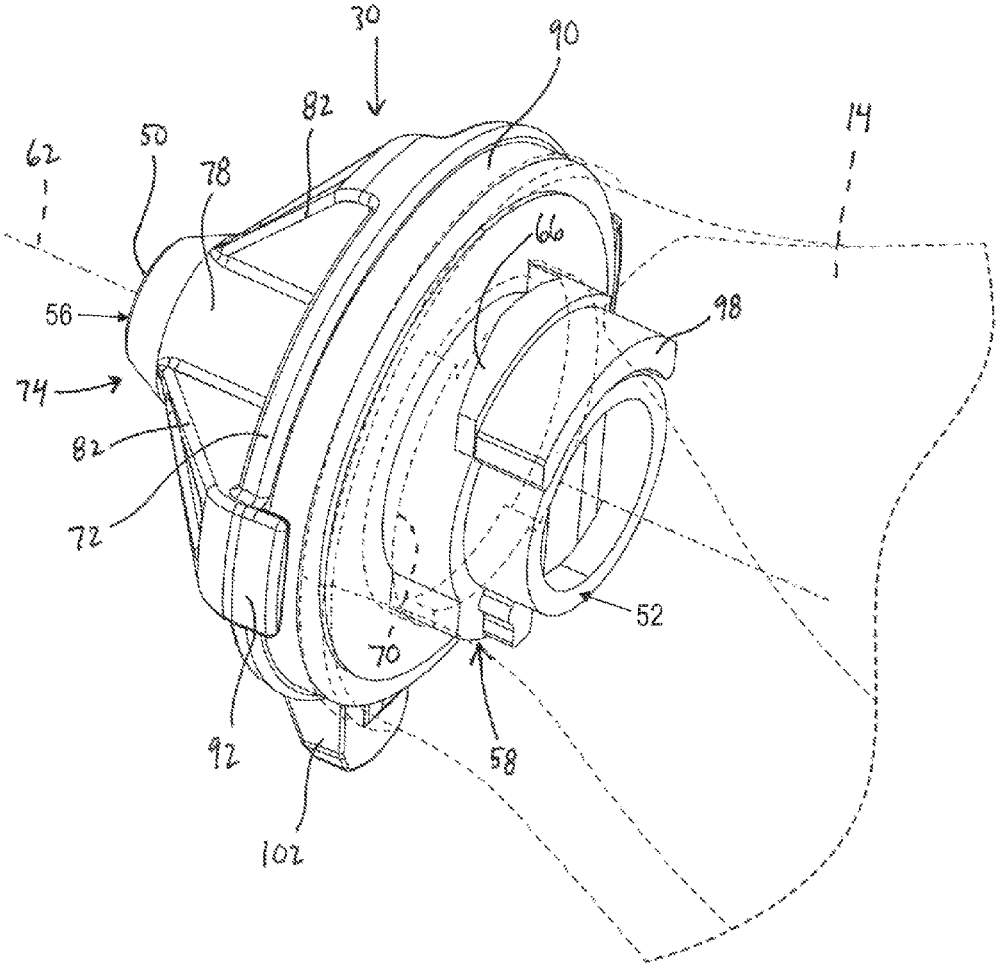
FIG. 3 is a perspective view of a cap for a chalk line device.

FIGS. 2 and 3 illustrate the cap 30 and a portion of the housing 14, which includes an opening 54. The cap 30 includes a first end 52 (FIG. 3) and a second end 56 and defines a cap axis 62 (FIG. 3) extending between the first end 52 and the second end 56. A shank portion 58 is positioned proximate the first end 52 and is removably received within the opening 54. The shank portion 58 includes a partial thread 66. The shank portion 58 is inserted into the opening 54 and the cap 30 is rotated about the cap axis 62 until the partial thread 66 engages a circumferential protrusion 70 formed on the housing 14 and extending around the opening 54. In the illustrated embodiment, the cap axis 62 is aligned with the nozzle 50. In one embodiment, the cap 30 is rotated through an angle less than 360 degrees about the cap axis 62 to secure the cap 30 to the housing 14. In another embodiment, the cap 30 is rotated through an angle less than 180 degrees about the cap axis 62 to secure the cap 30 to the housing 14. In one embodiment, the cap 30 is rotated through an angle of approximately 90 degrees about the cap axis 62 to secure the cap 30 to the housing 14.

Referring to FIG. 2, a flange 72 is positioned between the first end 52 and the second end 56 of the cap 30 and separates the shank portion 58 from a second or outer portion 74 from the shank portion 58. Stated another way, the flange 72 is oriented perpendicular to the cap axis 62 (FIG. 3). The outer portion 74 includes a central shaft 78 extending partially along the cap axis 62 away from the flange 72. Ridges 82 extend from an upper end of the central shaft 78 toward an outer edge or peripheral edge of the flange 72. In the illustrated embodiment, each ridge 82 is inclined downwardly toward the outer edge of the flange 72, and each ridge 82 is tapered such that a portion of each ridge 82 proximate the cap axis 62 is narrower than a portion proximate the outer edge of the flange 72. In the illustrated embodiment, the cap 30 includes four ridges 82 spaced apart from one another at equal angular intervals (i.e., 90 degrees about the cap axis 62).

An annular seal 90 is positioned between the flange 72 and the housing 14 to prevent chalk from leaking out of the housing 14. In the illustrated embodiment, two of the ridges 82 are positioned on diametrically opposite sides of the cap 30 and include ends 92 protruding below the flange 72. The seal 90 is positioned between the ends 92, and the ends 92 retain and align the seal 90 relative to the cap 30. A filter or cleaning element 94 is positioned in the shank portion 58 (FIG. 5) and wraps around the chalk line 18. As the chalk line 18 is retracted into the housing 14, the cleaning element 94 traps dirt or other impurities from being pulled into the housing 14 with the chalk line 18. In addition, an internal surface of the cap 30 may include a frustoconical formation 96 (FIG. 5) adjacent the cleaning element 94, such that when the chalk line 18 is extracted from the housing 14, the frustoconical formation 96 engages the cleaning element 94 and urges it away from the nozzle 50. A clip 98 is inserted into the shank portion 58 to secure the cleaning element 94 within the shank portion 58. In the illustrated embodiment, the clip 98 is inserted laterally into the shank portion 58, in a direction perpendicular to the cap axis 62.

In some embodiments, the cleaning element 94 has an outer diameter between approximately 8.2 mm and approximately 8.8 mm, and a length between approximately 11.7 mm and approximately 12.3 mm. In some embodiments, the cleaning element 94 has a nominal density of between approximately 3.1 g/cc and approximately 3.5 g/cc. In some embodiments, the cleaning element 94 has a nominal density of approximately 3.3. g/cc. The cleaning element 94 may be formed from wool felt and may have a material grade of F5. The characteristics of the cleaning element 94 provides a balance by allowing the chalk line 18 to pass through easily without resulting in high stress on the chalk line 18, while still being sufficiently tight to prevent spillage of the chalk contained within the housing 14.

Figure 4:
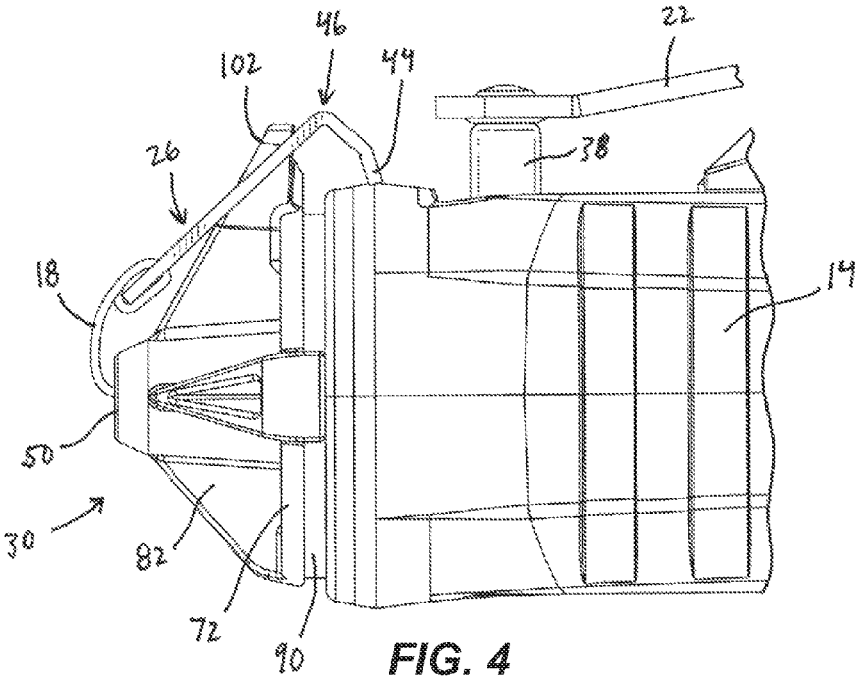
FIG. 4 is a side view of a portion of the chalk line device.

As shown in FIGS. 1 and 4, the cap 30 includes a mechanism for securing the hook 26 relative to the cap 30. In the illustrated embodiment, one of the ridges 82 forms a projection 102 extending radially beyond the peripheral or outer edge of the flange 72. The projection 102 has a more shallow slope or taper than the other ridges 82. The projection 102 is positioned in the slot 46 (FIG. 1) and engages an edge of the slot 46 to secure the hook 26 against movement. Stated another way, the hook 26 is aligned along the ridge forming the projection 102 such that the projection 102 extends through the slot 46. In other embodiments, the projection 102 may be received within a gap or space 100 (FIGS. 1 and 2) between portions of the gripping edge 44. In still other embodiments, multiple ridges 82 may include projections extending beyond the outer edge of the flange 72. Securing the hook 26 against the cap 30 provides a compact storage configuration to insure that the hook 26 does not snag on clothing or other items. Furthermore, by engaging the cap 30 instead of the housing 14, less chalk line is extracted from the housing 14 and exposed during storage.

Figure 5:
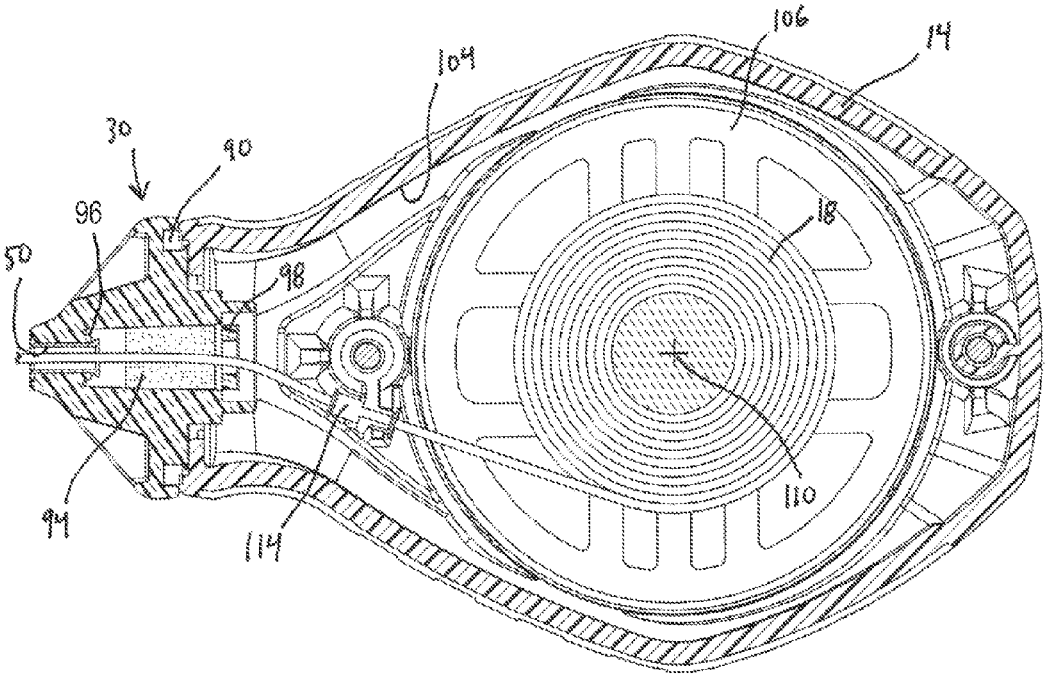
FIG. 5 is a section view of the chalk line device of FIG. 1 viewed along section 5-5.

As shown in FIG. 5, the housing 14 defines a chalk chamber or internal chamber 104 supporting a spool 106. The spool 106 is rotatable relative to the housing 14 about a spool axis 110. The chalk line 18 is wrapped onto the spool 106 while the chalk line 18 is stored, and the line 18 may be unwrapped from the spool 106 by applying a force on the chalk line 18. The internal chamber 104 contains a chalk material (not shown) that coats the chalk line 18 positioned in the internal chamber 104. In the illustrated embodiment, the housing 14 supports a guide tube 114 through which the chalk line 18 passes between the spool 106 and the cap 30. The guide tube 114 defines the path of the chalk line 18 and insures that the chalk line 18 does not rub on any internal surfaces of the housing 14, thereby reducing wear on the chalk line 18.

Figure 6:
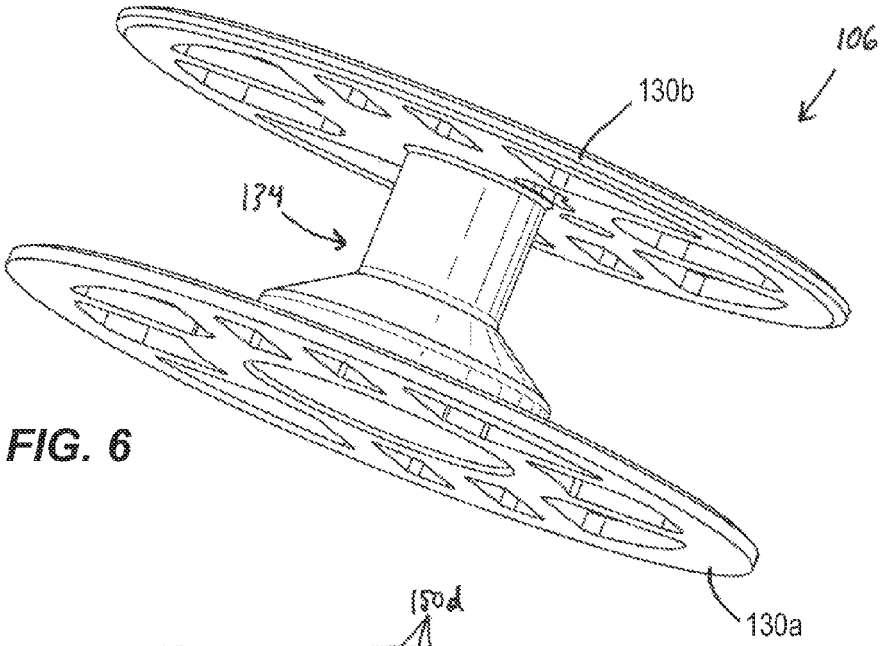
FIG. 6 is a perspective view of a spool.
Figure 7A:
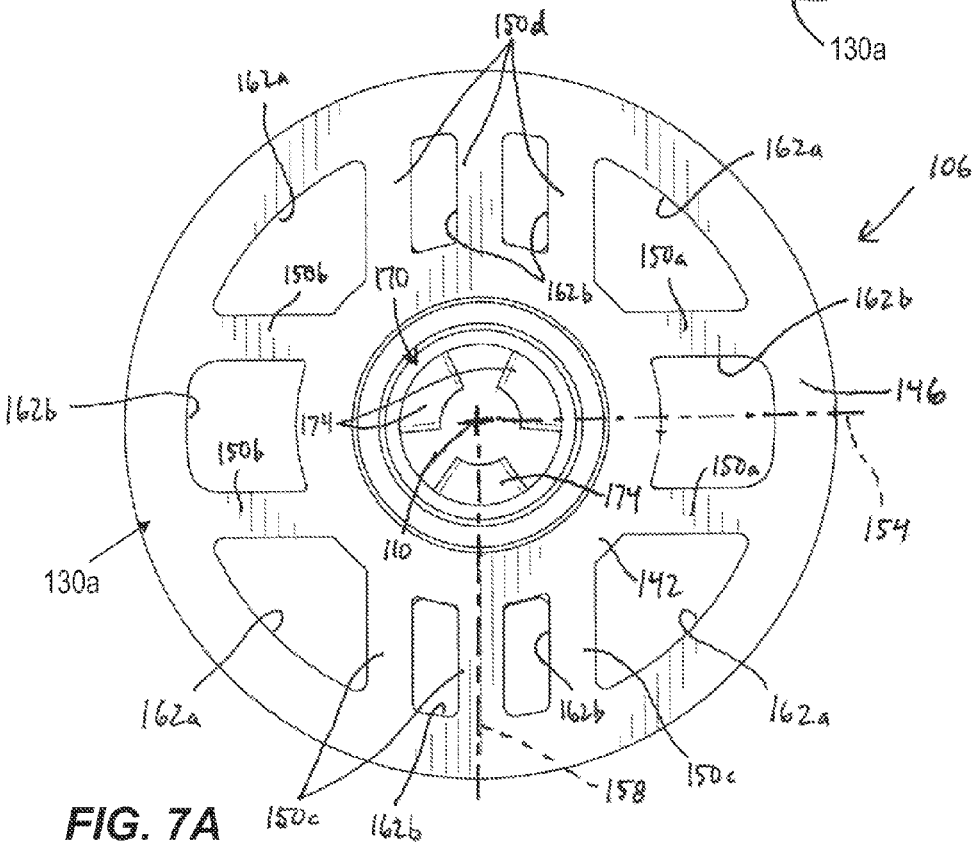
FIG. 7A is a side view of the spool of FIG. 6.
Figure 7B:
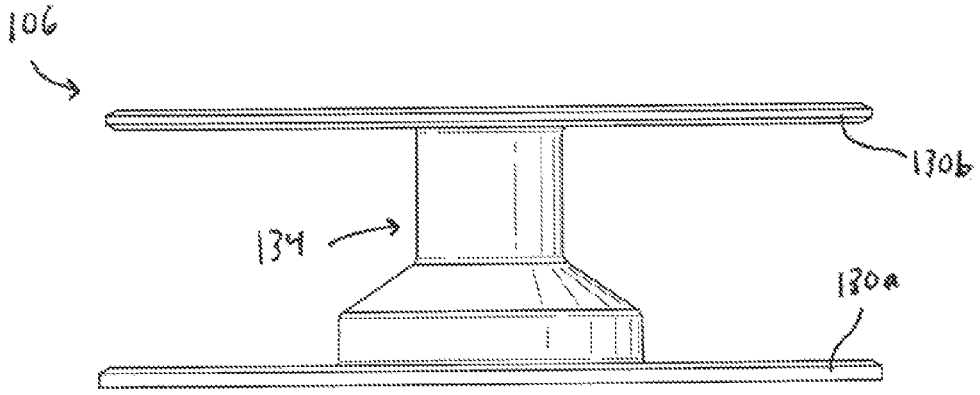
FIG. 7B is a front view of the spool of FIG. 6.

As shown in FIGS. 6 and 7A, the spool 106 includes a first side wall 130*a*, a second side wall 130*b*, and a hub 134 extending between the side walls 130. As shown in FIG. 7B, in the illustrated embodiment, the hub 134 is generally cylindrical, and a portion of the hub 134 proximate one side wall 130 has a frustoconical shape. The chalk line 18 (FIG. 5) is wrapped around the hub 134. Referring to FIG. 7A, each side wall 130 includes an inner portion 142 positioned adjacent the hub 134 and a peripheral portion 146 positioned radially outward of the inner portion 142. In addition, support members 150 extend between the inner portion 142 and the peripheral portion 146. In the illustrated embodiment, the support members 150 are arranged in groups at 90 degree intervals around the spool axis 110. Each support member 150 is oriented parallel to and offset from a radial line that extends outwardly from the spool axis 110 toward the peripheral portion 146.

For purposes of illustration, a first radial reference line 154 is illustrated in FIG. 7A and extends outwardly from the spool axis 110. A pair of parallel support members 150*a* are offset from either side of the first radial reference line 154. A pair of support members 150*b* are positioned 180 degrees apart from the support members 150*a* and positioned in a similar manner. A second radial reference line 158 extends from the spool axis 110 at 90 degrees to the first reference line 154. Three support members 150*c* are oriented parallel to the second reference line 158, with one of the support members 150*c* aligned with the second reference line 158 and the other two support members 150*c* are positioned on either side and offset from the second reference line 158. A group of support members 150*d* are positioned 180 degrees apart from the support members 150*c* and are positioned in a similar manner. In the illustrated embodiment, each of the four groups of support members 150*a*, 150*b*, 150*c*, 150*d* are spaced apart from one another at 90 degree angular intervals about the spool axis 110.

Openings 162 are defined between the support members 150 and extend through each side wall 130. A group of first openings 162*a* are positioned in an angular region between each adjacent group of support members 150, such that the first openings 162*a* form a generally triangular shape. A group of second openings 162*b* are positioned between each of the support members 150 in each group. The openings 162 permit chalk in the internal chamber 104 to pass through the side walls 130, thereby penetrating the space between the side walls 130 and more thoroughly coating the chalk line 18 wrapped on the spool 106.

Although the support members 150 and openings 162 have been described in detail with respect to the first side wall 130*a*, it is understood that the second side wall 130*b* includes similar support members 150 and openings 162. In other embodiments, the support members 150 and openings 162 may be formed in a different manner. In other embodiments, the support members 150 and openings 162 of each side wall 130 may not be identical, and/or may not be aligned with one another.

Figure 7C:
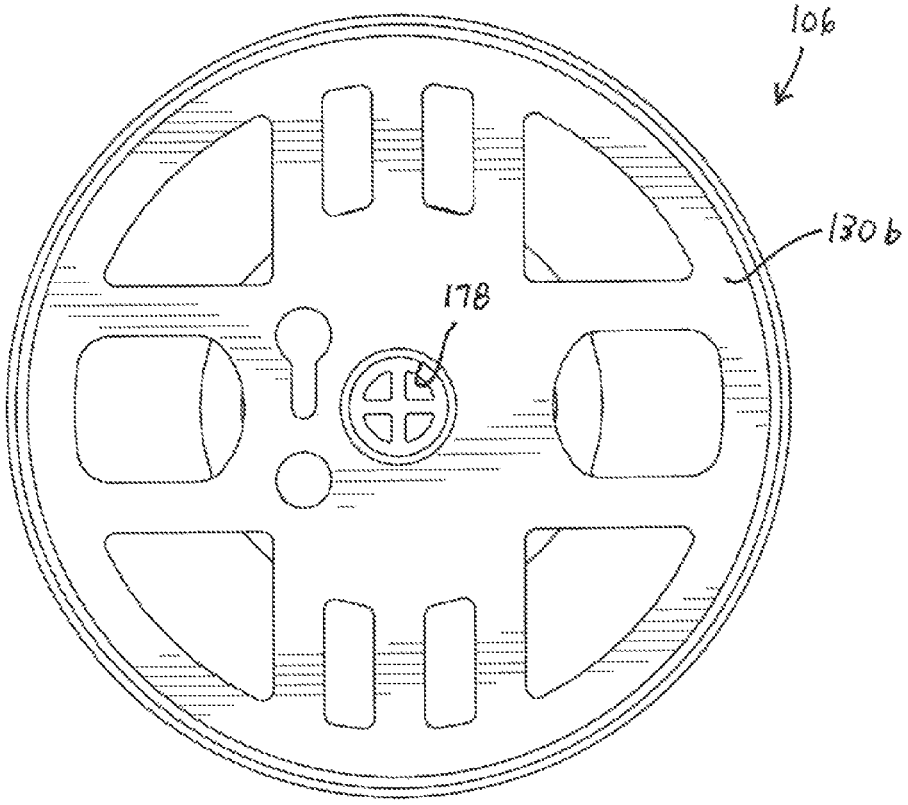
FIG. 7C is a reverse side view of the spool of FIG. 6.

As shown in FIG. 7A, the spool 106 includes a clutch surface 170 positioned on a first side wall 130*a*, and the clutch surface 170 includes driven clutch teeth 174. In the illustrated embodiment, the clutch surface 170 is concentric with the spool axis 110 and includes three driven clutch teeth 174 positioned at equal angular intervals around the spool axis 110. As shown in FIGS. 7B and 7C, the second side wall 130*b* is positioned on the hub 134 opposite the clutch surface 170, and the second side wall 130*b* includes an opening 178 (FIG. 7C). In one embodiment, the first side wall 130*a* and second side wall 130 may have different diameters, such that one side wall is smaller than the other.

Figure 8:
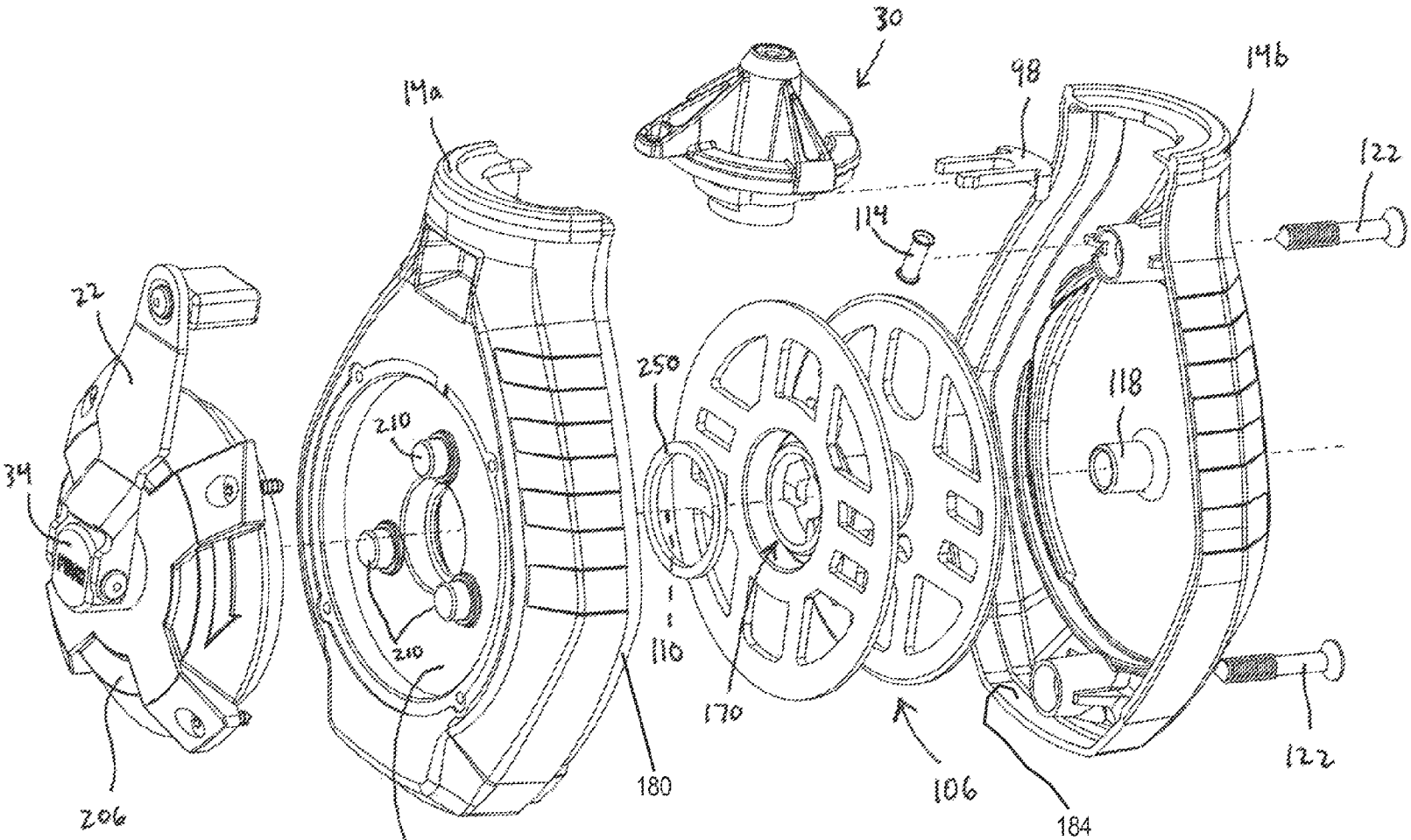
FIG. 8 is an exploded view of the chalk line device of FIG. 1.

As shown in FIG. 8, in the illustrated embodiment the housing 14 is formed as two portions 14*a*, 14*b* coupled together. An inner surface of portion 14*b* includes a support post 118, and the support post 118 is received in the opening 178 of the second side wall 130*b* to support the spool 106 for rotation about the spool axis 110. The portion 14*a* includes an extended wall portion 180 protruding beyond the edge of the housing portion 14*a*. The extended wall portion extends substantially around the perimeter of the housing portion 14*a* and is received in a recess 184 formed on an inner surface of the portion 14*b* when the housing portions 14*a*, 14*b* are assembled together. In one embodiment, the extended wall portion 180 protrudes 4.6 mm beyond the edge of the housing portion 14*a*. In the illustrated embodiment, the portions 14*a*, 14*b* are coupled together by a pair of retention screws 122. Each screw 122 may be unthreaded from the portion 14*a* to release the portion 14*a*, yet remain coupled to the portion 14*b* by a washer 128 (FIG. 10) secured to the portion 14*b*.

Figure 9:
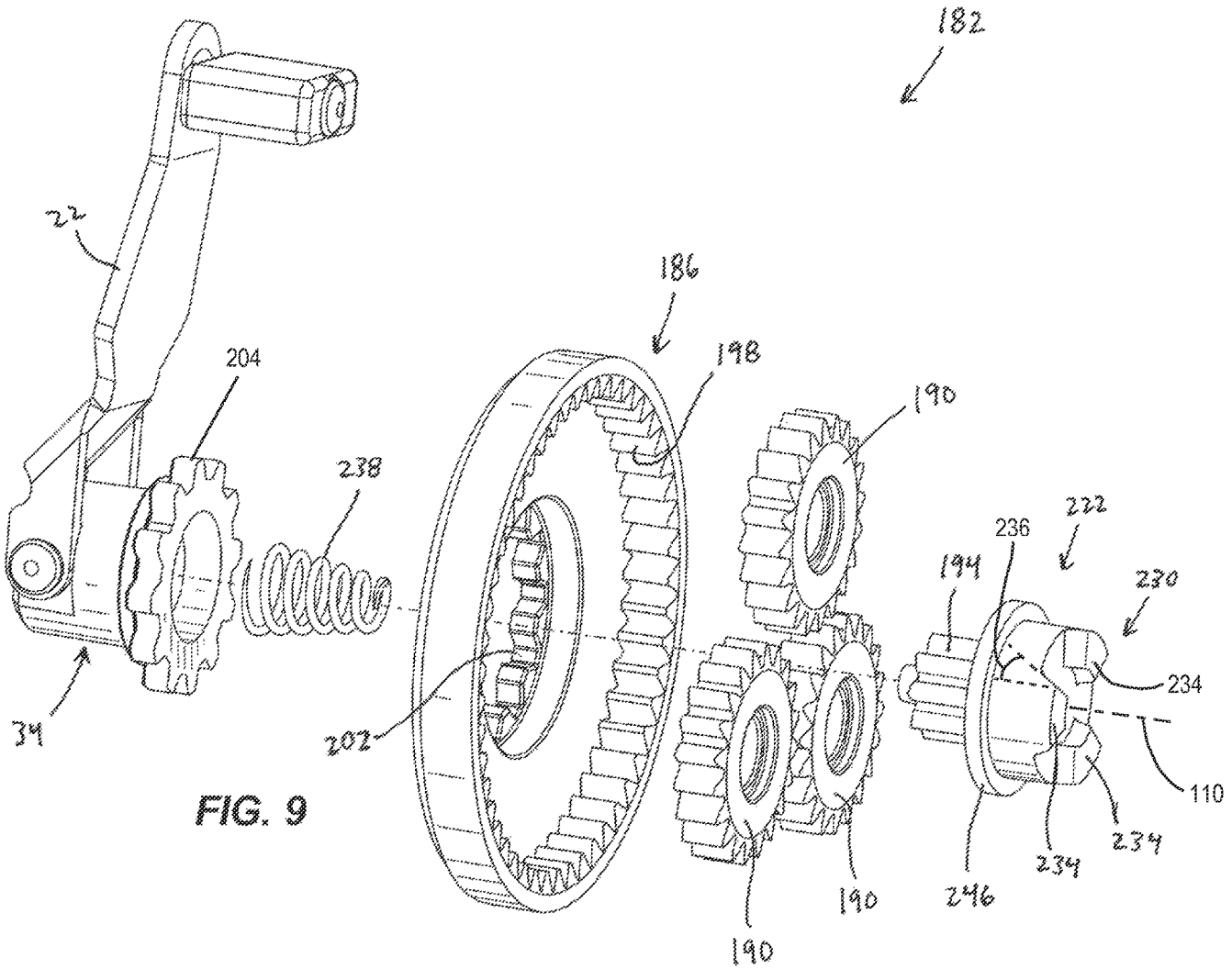
FIG. 9 is an exploded view of a drive mechanism.
Figure 10:
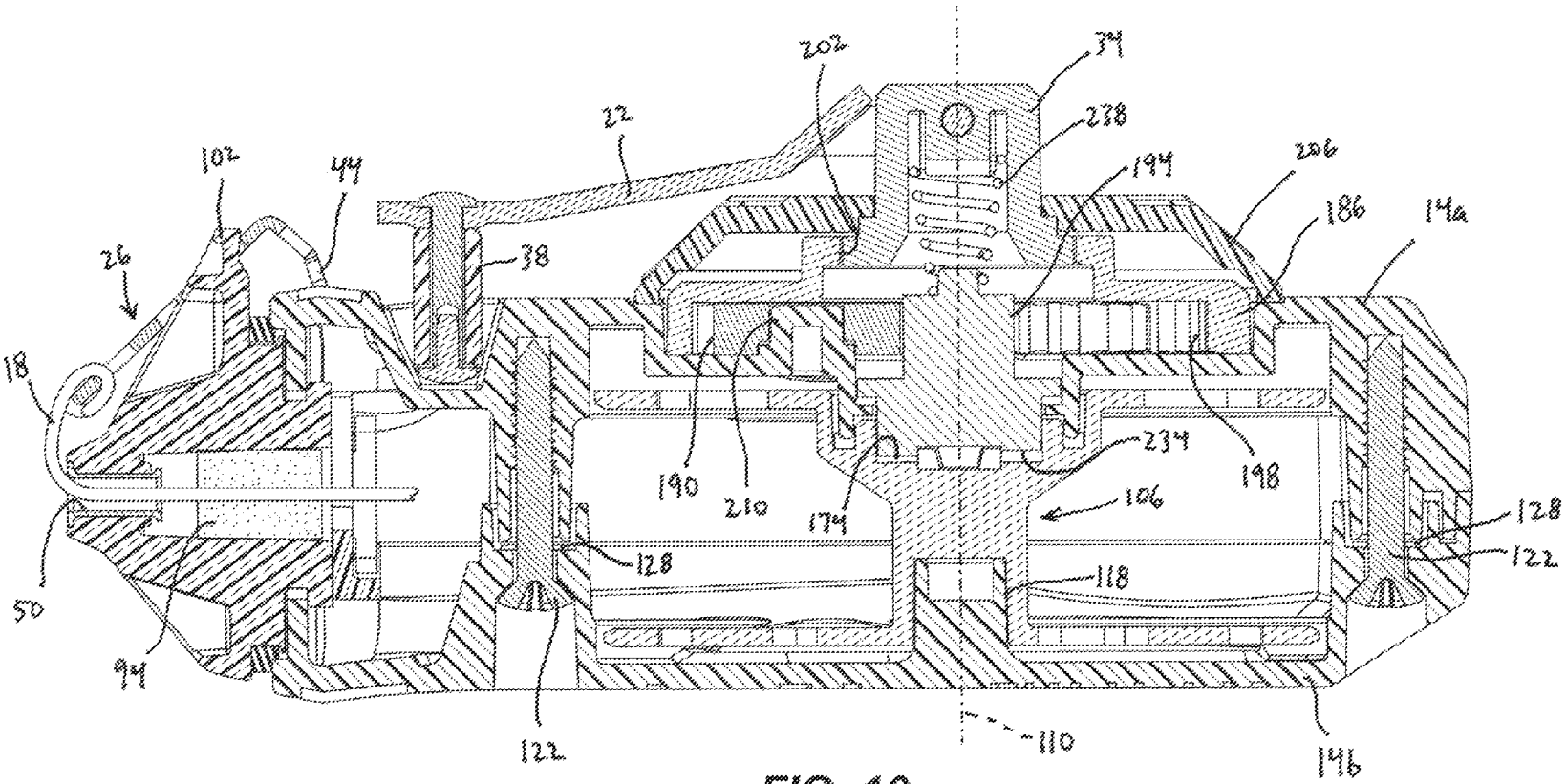
FIG. 10 is a section view of the chalk line device of FIG. 1 viewed along section 10-10.

Referring now to FIGS. 9 and 10, the lever 22 is drivingly connected to the spool 106 (FIG. 10) by a drive mechanism 182. The drive mechanism 182 transmits torque applied on the lever 22 by a user to rotate the spool 106 and wind in the chalk line 18. The drive mechanism 182 includes a planetary gear drive including a ring gear 186, planet gears 190, and a sun gear 194. The ring gear 186 includes internal teeth 198 and a hole 202 for receiving an end of the post 34 supporting the lever 22. In the illustrated embodiment, the end of the post 34 includes a spur gear 204 having teeth that mesh with complementary teeth extending around the hole 202 on the ring gear 186. The ring gear 186 is positioned between the housing 14 and a cover 206 (FIG. 10) that is fastened to the housing 14. The post 34 extends through the cover 206 and is rotatable relative to the cover 206.

In some embodiments, the spur gear 204 includes 12 teeth and has a nominal thickness of approximately 2.8 mm. The nominal outer diameter of the teeth may be between approximately 23.94 mm and approximately 24.06 mm, and the nominal root diameter of the teeth may be between approximately 19.56 mm and approximately 19.72 mm. In some embodiments, the outer diameter of the teeth is approximately 24 mm and the root diameter is approximately 19.6 mm. The large contact surface area between the spur gear teeth provides better engagement with the teeth around the hole 202 to transmit force to the ring gear 186 and reduces the contact stress and wear between the components and tends to reduce slippage between the spur gear 204 and the teeth around the hole 202.

The planet gears 190 are each supported on a pin 210 (FIGS. 8 and 10) extending from a partition or dividing wall 214 of the housing 14. Referring to FIGS. 9 and 10, each planet gear 190 is positioned between and meshes with the both the ring gear 186 and the sun gear 194. Rotation of the ring gear 186 causes the planet gears 190 to rotate about their respective pins 210, which in turn drives the sun gear 194 to rotate about its axis. In the illustrated embodiment, the pins 210 are spaced at equal angular intervals about the spool axis 110, and the drive mechanism 182 includes three planet gears 190; in other embodiments, the drive mechanism 182 may include fewer or more planet gears 190 and the pins 210/gears 190 may be arranged in another manner. In the illustrated embodiment, the gear ratio from the ring gear 186 to the sun gear 194 is approximately 6:1. In other embodiments, the gear ratio may be higher or lower. Furthermore, in other embodiments, the planet gears 190 may be supported (e.g., on a carrier) such that the planet gears 190 may revolve around the spool axis 110.

The drive mechanism 182 is releasably coupled to the spool 106 by an overload clutch mechanism. As shown in FIGS. 9 and 10, the sun gear 194 is formed on one end of a gear member 222 extending along the spool axis 110. A second end of the gear member 222 includes a clutch element 230 (e.g., a jaw clutch) that engages the clutch surface 170 on the spool 106. In the illustrated embodiment, the gear member 222 is aligned with the spool axis 110. In addition, the clutch element 230 may include three jaw clutch teeth 234, which are spaced apart from one another at equal angular intervals around the spool axis 110. The side surfaces of the jaw clutch teeth 234 and the driven clutch teeth 174 are sloped to form an acute angle 236 (FIG. 9) relative to the spool axis 110. The jaw clutch teeth 234 are complementary to the driven clutch teeth 174 such that the jaw clutch teeth 234 fit into spaces or gaps between the driven clutch teeth 174 (and vice versa). The clutch element 230 is biased into engagement with the clutch surface 170 by a biasing element (e.g., a coil spring 238) positioned between the sun gear 194 and the end of the post 34 that engages the ring gear 186.

In some embodiments, the angle 236 is between approximately 45 degrees and approximately 75 degrees. In some embodiments, the heights of the side surfaces of the jaw clutch teeth 234 and driven clutch teeth 174 are between approximately 1.5 mm and approximately 2.5 mm. In some embodiments, the angle 236 is approximately 68 degrees, and the nominal heights of the side surfaces of the jaw clutch teeth 234 and the driven clutch teeth 174 are approximately 2 mm. The nominal spring force applied on the clutch element 230 by the spring 238 during normal operation is between approximately 10 N and 15.4 N (2.25 lbf-3.46 lbf).

During normal operation, a torque applied to the handle 38 rotates of the lever 22, thereby transmitting a torque to the ring gear 186 and the sun gear 194. The jaw clutch teeth 234 fit into the gaps between the driven clutch teeth 174, transmitting torque to the spool 106 to rotate the spool 106 about the spool axis 110. However, in some circumstances, the chalk line device 10 may jam. This may occur due to several reasons: for instance, the chalk line 18 may become caught on an object or wrapped around the outside wall of the spool 106; the chalk in the internal chamber 104 may accumulate adjacent the nozzle 50, making it difficult to reel in the line 18; or chalk may interfere with rotation of the spool 106 or may jam the gears of the drive mechanism 182. In these situations, a user typically applies additional torque on the lever 22, which, in a conventional chalk line device, causes either the line 18 to break or the gears to fracture or strip.

Figure 11:
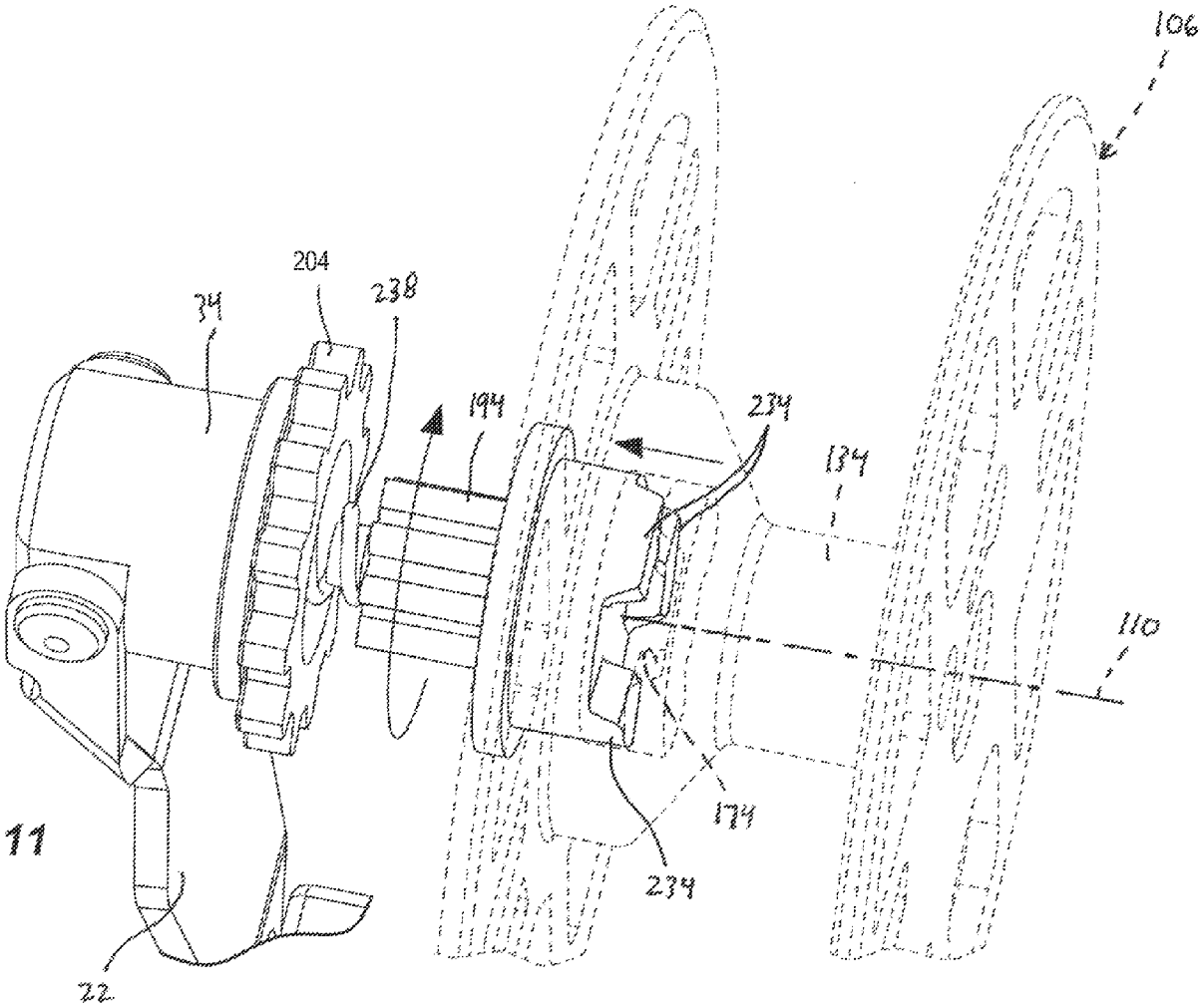
FIG. 11 is a perspective view of a lever, a gear member, and a spool.

As shown in FIG. 11, if the torque applied by the user exceeds a predetermined level, the jaw clutch teeth 234 will slip relative to the driven clutch teeth 174 of the clutch surface 170 on the spool 106. Stated another way, the sides of the jaw clutch teeth 234 slide along the sloped side surfaces of the driven clutch teeth 174. Due to the angular orientation of the side surfaces, the excessive torque will cause the gear member 222 to overcome the axial biasing force of the spring 238. In some embodiments, the magnitude of the angle 236 of the side surfaces of the jaw clutch teeth 234 at least partially determines the maximum torque before the gear member 222 overcomes the biasing force 238. The gear member 222 will move parallel to the spool axis 110 such that the jaw clutch teeth 234 move out of the gaps between the driven clutch teeth 174. The gear member 222 will continue to rotate until the jaw clutch teeth 234 drop into the next sequential gaps. The gear member 222 will continue to slip relative to the spool 106 if the torque still exceeds the predetermined level.

In some embodiments, the spring force and configuration and/or the dimensions of the clutch teeth 174, 234 are configured to provide a clutch torque (i.e., the torque at which the jaw clutch teeth 234 slip relative to the driven clutch teeth 174) between approximately 25 in-lbf and approximately 45 in-lbf. In one embodiment, the nominal spring force applied on the clutch element 230 by the spring 238 when the clutch element 230 is moving axially to slip relative to the driven clutch teeth 174 is between approximately 24.8 N and 30.2 N (5.58 lbf-6.79 lbf).

The overload clutch mechanism prevents excessive torque from being applied on the transmission components and the spool 106, reducing wear on the gears and preventing the line 18 from breaking. In addition, the free rotation of the lever 22 and post 34 during the overload condition provides a tactile indication to the user that the spool 106 is not rotating due to a jam or over-torque condition, thereby alerting the user to inspect and clean the spool 106 and/or drive mechanism 182. The user may access the internal components by opening the cover 206 on the housing 14 and/or by separating the housing portions 14*a*, 14*b*. In the illustrated embodiment, the overload clutch acts at the interface between the spool 106 and the drive mechanism 182 to disengage the spool 106 from the lever 22, rather than acting at the interface between the lever 22 and the drive gears. Because the clutch interface is downstream of the drive gears, even if a large torque is applied on the handle 38, the drive gears reduce the torque applied on the clutch components. This increases the working life of the clutch components due to the lower torque.

During the overload condition described above, the post 34 remains engaged with the ring gear 186 even though the gear member 222 slips relative to the spool 106. However, the drive mechanism 182 also includes a manual disconnect mechanism. Referring again to FIGS. 9 and 10, the post 34 may be manually pressed by a user to move the post 34 parallel to the spool axis 110, disengaging the post gear teeth from the complementary teeth in the hole 202 of the ring gear 186. The post 34 provides a manual disconnect that de-couples the lever 22 from the spool 106 in a different location from the overload clutch mechanism, since the manual disconnect disengages the input (lever 22) from the gears. In other embodiments, the chalk line device 10 may include an overload clutch mechanism as described without a manual disconnect mechanism (i.e., the post 34 may be coupled to the ring gear 186 at all times).

Figure 12:
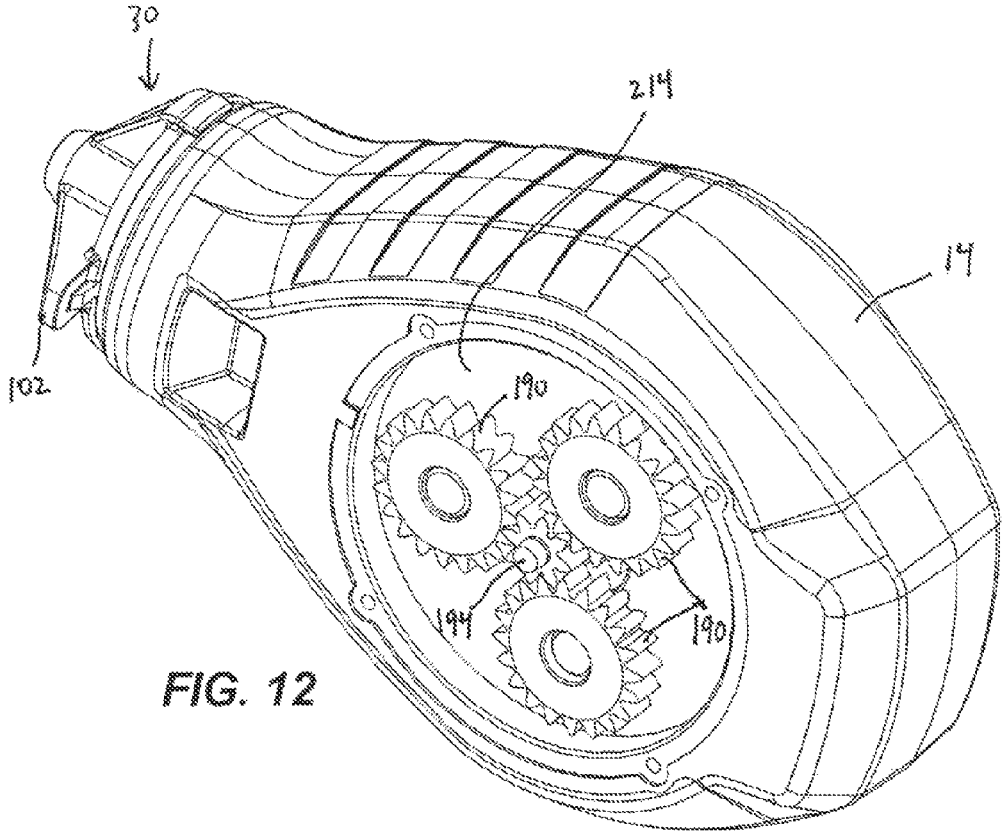
FIG. 12 is a perspective view of the chalk line device of FIG. 1 with a cover removed.

As shown in FIG. 12, the gear components (e.g., the ring gear 186, the planet gears 190, the sun gear 194) are separated from the internal chamber 104 of the housing 14 by the dividing wall 214 in order to prevent chalk from entering the spaces between the gear teeth and interfering with the interaction of the gears. The gear member 222, which extends through the dividing wall 214, includes a flange 246 (FIGS. 9 and 10) abutting the dividing wall 214. Furthermore, as shown in FIGS. 8 and 10, a seal 250 is positioned between the dividing wall 214 and the spool 106. Both the flange 246 and the seal 250 further prevent chalk from leaking into the drive or clutch mechanisms.

Although certain aspects have been described in detail with reference to certain preferred embodiments, variations and modifications exist within the scope and spirit of one or more independent aspects as described. Various features and advantages are set forth in the following claims.

We claim:

1. A chalk line device comprising:

a housing defining an outer surface and an internal chamber, the housing including an opening;

a spool supported in the internal chamber for rotation relative to the housing;

a chalk line extending through the opening of the housing, the chalk line including a first end and a second end, at least a portion of the chalk line wrapped around the spool;

a hook secured to the first end of the chalk line and including a tip adapted to engage a work piece; and a cap removably coupled to the housing to cover the opening, the cap including a nozzle through which the chalk line extends and a projection for engaging and releasably securing the hook against the cap.

2. The chalk line device of claim 1, wherein the cap is secured within the opening of the housing by rotating the cap through an angle less than 360 degrees relative to the housing.

3. The chalk line device of claim 2, wherein the cap is secured within the opening of housing by rotating the cap through an angle less than 180 degrees relative to the housing.

4. The chalk line device of claim 1, wherein the cap defines a peripheral edge and a plurality of ridges extending between the nozzle and the peripheral edge, wherein the projection is formed on at least one of the ridges and extends outwardly beyond the peripheral edge.

5. The chalk line device of claim 1, wherein the cap defines a flange having a peripheral edge and a plurality of ridges extending between the nozzle and the peripheral edge, the ridges spaced apart at equal angular intervals around the nozzle.

6. The chalk line device of claim 5, further comprising a seal positioned between the flange and the housing, wherein the plurality of ridges includes a pair of ridges positioned on opposite sides of the cap, each of the pair of ridges including an end protruding away from the flange, the ends aligning the seal relative to the cap and the housing.

7. The chalk line device of claim 5, wherein the ridges are inclined downwardly from the nozzle toward the peripheral edge such that the cap has a generally frustoconical profile.

8. The chalk line device of claim 1, wherein the hook includes an opening positioned between the first end of the chalk line and the tip, wherein the projection is positioned in the opening to secure the hook against the cap.

9. The chalk line device of claim 1, wherein the housing includes a first portion and a second portion, the first portion including an extended wall protruding a distance beyond an edge of the first portion by approximately 4.6 mm, the second portion including a recess receiving the extended wall.

10. A chalk line device comprising:

a housing defining an outer surface and an internal chamber, the housing including an opening;

a spool supported in the internal chamber for rotation relative to the housing about a spool axis;

a chalk line extending through the opening of the housing, at least a portion of the chalk line wrapped around the spool;

a drive mechanism for rotating the spool, the drive mechanism including a gear member and a lever, the gear member directly coupled to the spool at a spool interface, the lever positioned proximate the outer surface and supported for rotation relative to the housing, rotation of the lever transmitting a torque to the gear member and the gear member in turn transmits a torque to the spool to rotate the spool; and a clutch mechanism for selectively uncoupling the gear member from the spool at the spool interface when a torque transmitted by the gear member to the spool exceeds a predetermined threshold.

11. The chalk line device of claim 10, wherein the clutch mechanism includes a jaw clutch engagement formed between the gear member and the spool.

12. The chalk line device of claim 10, wherein the gear member includes a first end and a second end, the gear member rotatable about a gear axis extending between the first end and the second end, the gear member including a gear surface positioned proximate the first end, wherein the clutch mechanism includes a clutch positioned on the second end of the gear member and engaging an outer surface of the spool.

13. The chalk line device of claim 12, wherein the clutch includes sliding jaw surfaces and the outer surface of the spool includes driven jaw surfaces in contact with the sliding jaw surfaces, wherein the sliding jaw surfaces form an acute angle relative to the gear axis such that the sliding jaw surfaces slip relative to the driven jaw surfaces when the torque transmitted by the gear member exceeds the predetermined threshold.

14. The chalk line device of claim 13, further comprising a spring biasing the sliding jaw surface along the gear axis and into engagement with the driven jaw surfaces.

15. The chalk line device of claim 10, wherein the drive mechanism includes a ring gear and at least one planet gear, the ring gear coupled to the lever and rotatable with the lever, each planet gear positioned between the ring gear and the gear member to transmit torque from the lever to the gear member.

16. The chalk line device of claim 10, wherein the internal chamber houses a chalk material for adhering to the chalk line, wherein the housing further includes a partition wall having a first side adjacent the internal chamber and a second side opposite the first side, wherein at least a portion of the drive mechanism is positioned on the second side.

17. The chalk line device of claim 16, wherein the gear member extends through the partition wall such that first end of the gear member is positioned proximate the first side of the partition wall and a second end of the gear member is positioned proximate the second side of the partition wall.

18. A chalk line device comprising:

a housing defining an outer surface and an internal chamber, the housing including an opening;

a lever supported for rotation relative to the housing;

a chalk line extending through the opening of the housing such that an end of the chalk line is positioned outside of the internal chamber and a portion of the chalk line is supported in the internal chamber;

a spool supported in the internal chamber for rotation relative to the housing about a spool axis, the spool driven by rotation of the lever, the spool including a pair of side walls and a hub extending between the pair of side walls, the hub extending around the spool axis such that the portion of the chalk line is wrapped around the hub, at least one of the side walls including an inner portion, a peripheral portion, and a plurality of support members extending between the inner portion and the peripheral portion, each support member oriented parallel to and offset from a radial line that extends outwardly from the spool axis toward the peripheral portion, the plurality of support members defining a plurality of openings positioned between each of the support members and extending through the side wall to permit chalk to pass through the side wall.

19. The chalk line device of claim 18, wherein the plurality of support members is a plurality of first support members, the chalk line device further comprising a plurality of second support members extending between the inner portion and the peripheral portion, each of the second support members collinear with a radial line extending outwardly from the spool axis toward the peripheral portion.

20. The chalk line device of claim 18, wherein the plurality of openings includes a plurality of first openings and a plurality of second openings, the first openings spaced apart from one another at ninety degree angular intervals about the spool axis, each of the first openings defining a generally triangular shape.

21. The chalk line device of claim 20, wherein the plurality of support members includes four groups of support members spaced apart at ninety degree angular intervals about the spool axis, wherein each of the second openings is positioned between the support members of one of the groups of support member.

* * * * *